United States Patent [19]

Chen

[11] Patent Number: 4,909,755

[45] Date of Patent: Mar. 20, 1990

[54] CONDUCTING TERMINAL OF A TELEPHONE CORD PLUG

[76] Inventor: Swan Chen, 2F, No. 28, Industry East Rd. IV, Science-Based Industrial Park, Hsinchu 30077, Taiwan

[21] Appl. No.: 281,369

[22] Filed: Dec. 8, 1988

[51] Int. Cl.[4] ..... H01R 4/24

[52] U.S. Cl. ..... 439/418; 439/676; 439/404; 439/401

[58] Field of Search ..... 439/389–i403, 439/417, 418, 419, 425, 426, 676, 344, 741, 751, 404

[56] References Cited

U.S. PATENT DOCUMENTS

| | | | |
|---|---|---|---|
| 4,174,877 | 11/1979 | Foederer | 439/425 |
| 4,650,269 | 3/1987 | Denkmann et al. | 439/426 |
| 4,679,878 | 7/1987 | Volk | 439/425 |
| 4,749,366 | 6/1988 | McCaffery | 439/396 |

FOREIGN PATENT DOCUMENTS

| | | | |
|---|---|---|---|
| 2531277 | 2/1984 | France | 439/397 |

*Primary Examiner*—David Pirlot

*Attorney, Agent, or Firm*—Schwartz & Weinrieb

[57] ABSTRACT

A conducting terminal of a telephone cord plug, which has two claws with a pair of opposite inclined surfaces capable of closely clamping the inner copper wire of the telephone cord jack for current-conduction with minimum damage to the copper wire when inserted into the telephone cord jack, is disclosed. A middle projecting tang or member is also provided between the above two claws so as to only pierce through the outer cover of the telephone cord for enhancing the association of the conducting terminal with the telephone cord jack. A plurality of projecting detents are also defined upon the conducting terminal so as to engage the guide plates of the jack, thereby preventing seperation of the conducting terminal from the jack.

5 Claims, 3 Drawing Sheets

CONDUCTING TERMINAL OF A TELEPHONE CORD PLUG

FIELD OF THE INVENTION

The present invention relates to a conducting terminal of a telephone cord plug, which can be more securely connected to the corresponding telephone cord jack with minimum damage to the inner copper wire.

BACKGROUND OF THE INVENTION

There are some shortcomings which exist in conventional telephone cord plug. The critical cause of these problems is that the design of the conducting terminal of the conventional plug is potentially operatively defective. Generally, the prior art conducting terminal has two sharp claws which are inserted through the outer cover of the telephone cord so as to contact the inner copper wire for current-conduction. As a result of such contact, since the sharp tips of the claws pierce the upper surface of the copper wire, the copper wire is very likely to be damaged (as shown in FIG. 2). As a result, an undetected circuit-break may occur within the telephone cord and render the entire telephone set useless.

Furthermore, as the conventional conducting terminal is provided with smooth side walls, and the guide plate of the prior art telephone cord jack for guiding the conducting terminal is also disposed parallel thereto and provided with smooth side walls, it is therefore likely that the conducting terminal will become loosened from the jack as a result of the low frictionally binding force defined therebetween.

OBJECT OF THE INVENTION

It is therefore an object of the present invention, to provide a conducting terminal of a telephone cord plug so as to eliminate the above described disadvantages.

SUMMARY OF THE INVENTION

According to the conducting terminal for a telephone cord plug of the present invention, the same is provided with two claws defining a pair of oppositely disposed inclined surfaces which are capable of closely clamping the inner copper wire of the telephone cord jack for current-conduction with minimum damage to the copper wire when inserted into the telephone cord jack, such also serving as an object of the present invention.

According to the conducting terminal for a telephone cord plug of the present invention, a middle projecting tang or member is also provided between the above two claws so as to first pierce through the outer cover of the telephone cord for enhancing the association of the conducting terminal with the telephone cord jack, such being still another object of the invention.

According to the conducting terminal for a telephone cord plug of the present invention, a plurality of projecting detents are also provided on the conducting terminal so as to contact the side walls of the guide plates of the jack, thus preventing seperation of the conducting terminal from the jack, this being a further object of the present invention.

BRIEF DESCRIPTION OF THE DRAWINGS

A more complete understanding of these and other features and advantages of the present invention will become apparent from a careful consideration of the following detailed description of certain embodiments illustrated in the accompanying drawings, wherein.

DETAILED DESCRIPTION OF THE PREFERRED EMBODIMENT

Figure 1:
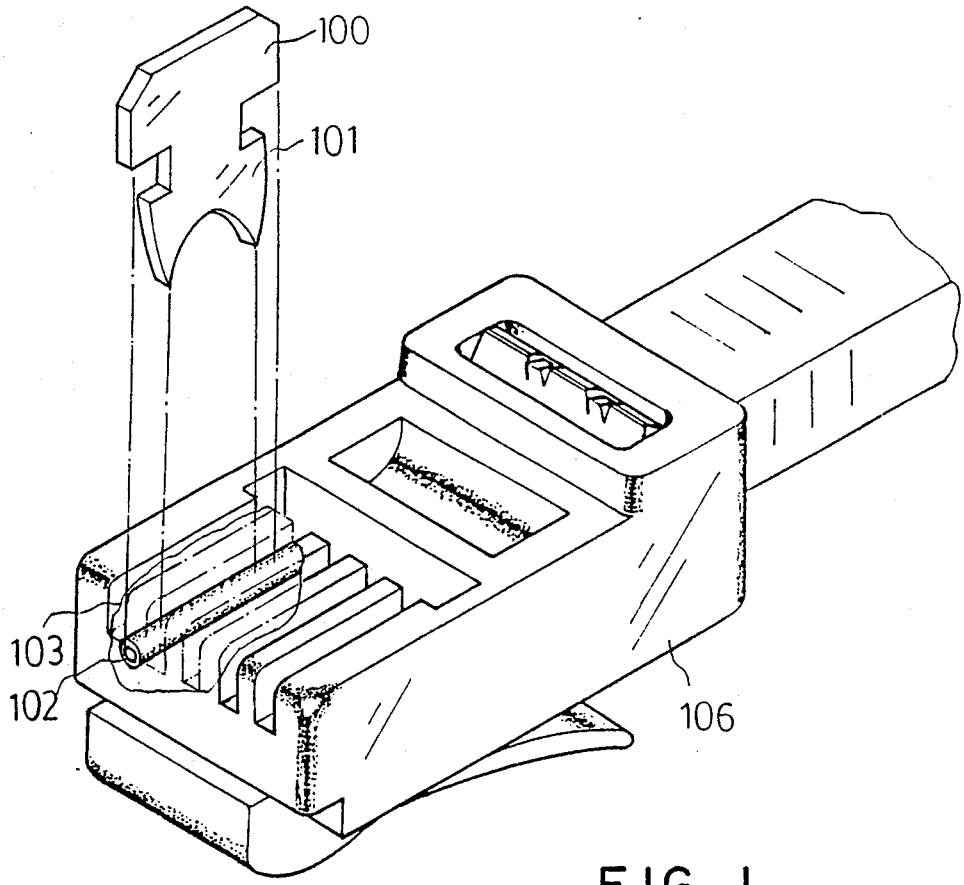
FIG. 1 PRIOR ART
FIG. 1 is a perspective view of the prior art conducting terminal with a partially cut away telephone cord jack also shown.
Figure 2A:
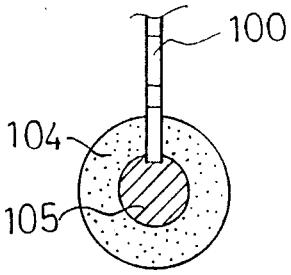
FIG. 2 shows the prior art conducting terminal associated with a fragmental telephone wire with the cross-section also shown in FIG. 2A of the terminal and telephone wire.
Figure 2:
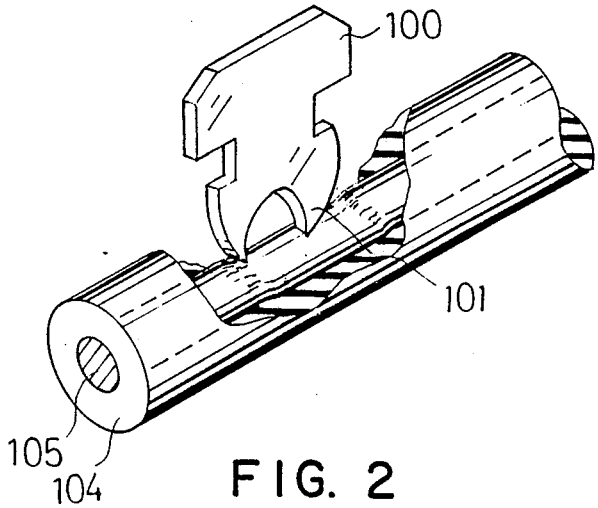
FIG. 2 PRIOR ART

Referring first to FIG. 1 and FIG. 2, the prior art conducting terminal has two claws 101 which can penetrate into the telephone cord 102 of the cord jack 106, contacting the upper surface of the inner copper wire 105 for establishing conduction. But since the claws 101 have very sharp tips to penetrate through the outer insulating cover 104 of the cord 102 and then contact the upper surface of the copper wire 105, they are also apt to damage or distort the copper wire 105, and cause a circuit-break within the telephone set.

Furthermore, the conducting terminal guide plate 103 of the cord jack 106 comprises a plurality of divider members provided with smooth said walls, and thus, the conducting terminal 100 is likely to seperate from the jack 106 as a result of the low frictionally binding force, defined therebetween, after a period of use.

Figure 4A:
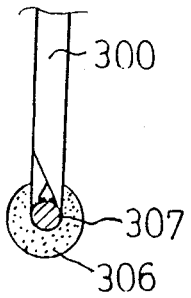
FIG. 4 shows the present conducting terminal associated with a fragmental telephone wire with the cross-section thereof also shown in FIG. 4A.
Figure 4:
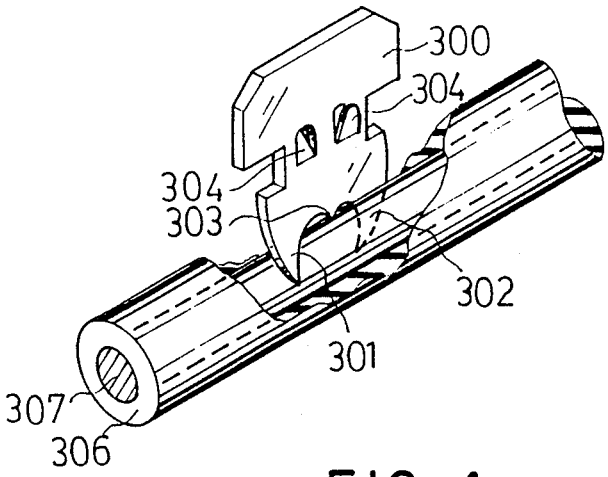
Figure 3A:
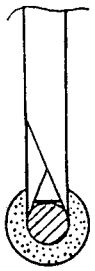
FIG. 3 shows a perspective view of the present conducting terminal and a partial cut away telephone cord jack with the cross-sectional view of the terminal and the telephone wire also shown in FIG. 3A.
Figure 3:
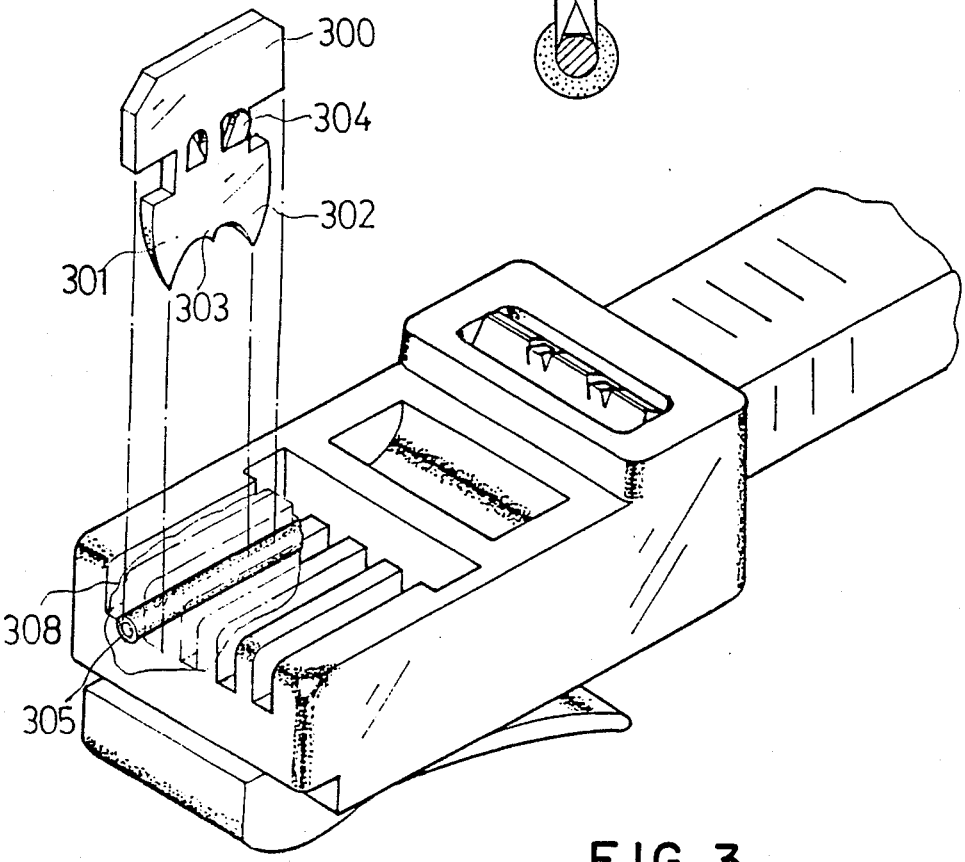

Now referring to FIG. 3 and FIG. 4, instead of the prior art conducting terminals, the present invention conducting terminal 300 has two claws 301, 302 having a pair of oppositely inclined surfaces which can closely clamp the inner copper wire 307 for current conduction without penetration thereinto when inserted through the outer cover 306 of the telephone cord 305. Thus, the damage to copper wire 307 can be minimized so as to avoid a circuit-break.

Additionally, a middle projecting tang or member 303 is provided between claws 301 and 302 so as to only pierce outer cover 306 without further piercing the inner copper wire 307 for enhancing the association of the conducting terminal 300 with the telephone core 305. Furthermore, using a punch, two or more upwardly inclined projecting detents 304 can be defined at the median position of the conducting terminal 300 so as to contact the side walls of the guide plate 308 thereby, preventing the conducting terminal 30 from becoming disengaged from the telephone cord jack when engaged therewith.

According to the above embodiment, the connection of the conducting terminal 300 to the telephone cord jack can be greatly improved with simple fabrication procedures and low cost, and the life of the elements can be considerably extended.

Obviously, many modifications and variations of the present invention are possible in light of the above teachings. It is therefore to be understood that within the scope of the appended claims, the present invention may be practiced otherwise than as specifically described herein.

I claim:

1. A conducting terminal of a telephone cord plug, which comprises:

an upper body portion having a predetermined thickness as defined by means of first and second planar surfaces; and two claws having a pair of oppositely disposed inclined surfaces, defined at longitudinally spaced edge portions of said body portion, which can closely clamp an inner conducting wire of a telephone cord jack without penetrating into said conducting wire for current conduction when said conducting terminal is inserted into said telephone cord jack through an outer cover thereof, each one of said two claws having its respective inclined surface extending from a first one of said first and second planar surfaces to a second one of said first and second planar surfaces such that the thickness of said conducting terminal within the region of said two claws is the same as said predetermined thickness of said upper body portion of said conducting terminal.

2. A conducting terminal as set forth in claim 1, wherein:

said inner conducting wire is fabricated from copper.

3. A conducting terminal of telephone cord as claimed in claim 1, wherein, a middle projecting member is provided between said two claws, capable of only penetrating said outer cover of said telephone cord jack without further piercing said inner conducting wire for increasing the connecting force of said conducting terminal to said telephone cord jack.

4. A conducting terminal of telephone core as claimed in claim 3, wherein, a plurality of projecting detents are provided on said conducting terminal so as to contact conducting terminal guide plates of said telephone cord jack, thereby preventing the detachment of said conducting terminal from said telephone cord jack.

5. A conducting terminal of telephone cord as claimed in claim 4, wherein, said projecting detents extend vertically upwardly in an inclined manner from opposite side surfaces of said conducting terminal.

* * * * *